US005361906A

United States Patent [19]

Sterett

[11] Patent Number: 5,361,906

[45] Date of Patent: Nov. 8, 1994

[54] FLUID CONTAINER WITH SUMP

[75] Inventor: Robert A. Sterett, Jackson, Mich.

[73] Assignee: Aeroquip Corporation, Maumee, Ohio

[21] Appl. No.: 193,257

[22] Filed: Feb. 8, 1994

Related U.S. Application Data

[60] Continuation of Ser. No. 19,614, Feb. 19, 1993, abandoned, which is a division of Ser. No. 780,112, Oct. 21, 1991, Pat. No. 5,197,601.

[51] Int. Cl.[5] ..... B65D 21/02

[52] U.S. Cl. ..... 206/509; 220/562; 220/4.13; 220/608; 220/4.27

[58] Field of Search ..... 137/590, 212; 222/377, 222/382, 464; 206/512, 511, 509, 503, 507; 220/562, 1.5, 4.27, 23.6, 23.83, 4.13, 4.12, 608, 636

[56] References Cited

U.S. PATENT DOCUMENTS

| | | | |
|---|---|---|---|
| 847,760 | 3/1907 | Gates | 222/382 |
| 2,753,079 | 7/1960 | Hersey | 222/382 |
| 2,937,879 | 5/1960 | Lion . | |
| 3,349,940 | 10/1967 | Cornelius | 220/636 |
| 3,474,843 | 10/1969 | Maris | 206/511 |
| 3,486,523 | 12/1969 | Mullings | 137/590 |
| 4,050,580 | 9/1977 | Wilson | 206/511 |
| 4,480,748 | 11/1984 | Wind | 206/511 |
| 4,557,406 | 12/1985 | Olinger | 222/377 |
| 4,573,603 | 3/1986 | Starling et al. | 206/509 |
| 4,648,521 | 3/1987 | Thomas et al. | 220/1.5 |
| 4,656,840 | 4/1987 | Loofbourrow et al. . | |
| 4,660,724 | 4/1987 | Gaynes . | |
| 4,782,973 | 11/1988 | Wiese | 220/4.12 |
| 4,785,958 | 11/1988 | Snyder | 220/4.12 |
| 4,883,251 | 11/1989 | Manas | 206/509 |
| 4,886,239 | 12/1989 | Stimmel . | |
| 4,917,246 | 4/1990 | Edelhoff | 220/1.5 |
| 4,919,296 | 4/1990 | Kirsh et al. . | |
| 4,932,551 | 6/1990 | Thomas et al. | 220/1.5 |
| 4,947,988 | 8/1990 | Schultz | 206/386 |
| 4,961,509 | 10/1990 | Currier | 220/1.5 |
| 4,989,741 | 2/1991 | Dull et al. | 206/512 |
| 5,029,734 | 7/1991 | Nichols | 206/600 |
| 5,038,954 | 8/1991 | Bromley | 220/23.83 |
| 5,064,101 | 11/1991 | Richter et al. | 222/464 |
| 5,205,434 | 4/1993 | Brunson et al. | 220/608 |
| 5,226,558 | 7/1993 | Whitney et al. | 206/503 |
| 5,271,515 | 12/1993 | Berkheimer et al. | 220/4.27 |
| 5,307,389 | 4/1994 | Meneely et al. | 220/4.12 |
| 5,307,956 | 5/1994 | Richter et al. | 222/444 |

FOREIGN PATENT DOCUMENTS

| | | | |
|---|---|---|---|
| 263450 | 7/1963 | Australia | 220/23.6 |
| 790060 | 11/1935 | France | 206/504 |
| 941834 | 1/1949 | France | 206/511 |
| 6401245 | 8/1964 | Netherlands | 206/511 |
| 401811 | 5/1966 | Switzerland | 220/636 |
| 426618 | 12/1966 | Switzerland | 206/511 |
| 2121766 | 1/1984 | United Kingdom | 220/23.6 |
| 480606 | 10/1975 | U.S.S.R. | 220/23.6 |

*Primary Examiner*—S. Castellano

*Attorney, Agent, or Firm*—Emch, Schaffer,Schaub & Porcello Co.

[57] ABSTRACT

A stackable container having excellent resistance to impact breakage includes (1) a plastic tank for containing liquids having at least one opening in its upper end and upper and lower abutments extending around sidewalls, (2) a top member engaged to the upper end of the tank having a downwardly facing abutting edge resting upon said upper abutment and (3) a bottom member engaged to the lower end of the tank having an upwardly facing abutting edge resting upon said lower abutment and having a plurality of downwardly extending legs. The tank has a generally rectangular configuration with a sump defined at one corner extending downwardly from the bottom and an internally raised area at another corner defining a depression forming an external ledge. Two tanks may be stacked in bottom-to-bottom relationship with the sump of one tank engaging the ledge of the other tank.

3 Claims, 9 Drawing Sheets

FLUID CONTAINER WITH SUMP

CROSS-REFERENCE TO RELATED APPLICATION

This application is a continuation of my U.S. application Ser. No. 08/019,614, filed Feb. 19, 1993, now abandoned which is a divisional application of U.S. patent Ser. No. 07/780,112, filed Oct. 21, 1991, now U.S. Pat. No. 5,197,601.

TECHNICAL FIELD

The present invention relates to a plastic container which has a high resistance to breakage even when dropped from heights as great as four feet in its most vulnerable position while filled with liquid and chilled to 0° F., which may be stacked one on top of another to heights approaching the top of a 14' high warehouse and which has a configuration for peak storage efficiency permitting virtually the entire contents to be pumped therefrom or thereinto even though similar containers may be stacked thereon.

BACKGROUND ART

In the use of chemicals such as pesticides and herbicides by the farmers, it is desirable to package such chemicals in a container which will withstand the rigors of handling, including bumping and dropping without breaking or cracking in order to avoid spillage of chemicals contained therein. Since containers providing such strength are fairly expensive, it is desirable that such containers be returnable and reusable. However, in supplying returnable and reusable containers for use in the field it is important to ensure that no other liquids be introduced into the container except by the chemical supplier in order to avoid contamination of the product contained therein. Accordingly, it is desirable that such containers be non-refillable except by the distributor, supplier or other responsible party having access to a special tool permitting introduction of the appropriate chemical into the container.

Although containers heretofore utilized have provided certain of the desired features for containing these types of chemicals, none have incorporated the total features or the significant features of the present invention.

DISCLOSURE OF THE INVENTION

The present invention is directed to a container having (1) a rotationally or otherwise molded plastic tank for containing liquids (2) a separately molded top member secured to the upper end of said tank and (3) a separately molded skid of bottom member secured to the lower end of said tank. The tank has a closed configuration except for one or two openings, preferably facing upwardly, through which liquid may be introduced into or dispensed from the tank. The second opening may be used for recirculation or filling at high GPM. The tank has recessed areas or wells in its upper end for receiving couplings and, if desired, a pump may be mounted on the upper end. The tank also has a sump forming the lowest area of the tank permitting maximum liquid evacuation from the tank with the lower end of the tank contoured to direct liquid into said sump; anti-bulge reinforcing for sides and ends of the tank; a configuration permitting efficient stacking of one tank upon another; engagement means for a chain hoist lifting; and hand grips for lifting empty containers. The container comprising the tank with the top and bottom members assembled thereto has coupling protection abutments or posts extending upwardly from a horizontal panel of the top member; stacking means including legs on the bottom member and recessed engagement ledges or pads on the top member; entry means between adjacent stacked containers for engagement by a fork lift from multiple directions; engagement means permitting tie-down of containers and four-way interlock between adjacent columns of stacked containers; a configuration permitting removal of liquid from or introduction of liquid into each of the containers stacked in a column; a configuration permitting 4×4 assembly on a standard size 42 inch by 48 inch pallet providing efficiency in warehouse utilization; reinforcing inserts for legs of bottom member; mating abutment means on the sidewall of said tank and (1) the lower edge of said top member and (2) the upper edge of said bottom member for transmitting loads from during impact thereon; double wall protection over major portions of the tank and a configuration resistant to damage from impact irrespective of location of impact; cooperating button type fasteners on the tank snapped into apertures in the top and bottom members for retaining the top and bottom members on the tank while providing the ability to remove and replace top member and/or bottom member in the event of damage to either such member; and precision mating of top member to the tank and bottom member to the tank by virtue of molding the tank with its exterior surface formed against the interior surface of a rotational mold and molding the top and bottom members with their interior surfaces formed against exterior surfaces of their respective vacuum molds.

If desired, the tank may be translucent thereby permitting a user to view how much liquid remains therein and the top and/or bottom members may be formed of various colors to permit color coding based upon the type of product contained therein. Such color coding will permit the chemical refiller to readily determine which specific chemical had been packaged therein. Additionally, the same top and bottom members may be used on tanks of varying sizes. Thus, a 15, 30 and 60 gallon tank will use the identical top and bottom members. The design permits water drainage from the top of the assembled components while preventing water from entering the bottom portion by way of tank overhang and efficient storage of the unassembled components. In the event of leakage from the lower portion of the tank in the area engaged by the skid/bottom member, such skid/bottom member will capture the liquid and prevent it from flowing directly from the source of leaking to the ground or warehouse floor, flowing instead to and oozing out of the apertures of the bottom member in which the button type fasteners are engaged to provide a leak detection feature.

Accordingly, it is an object of the present invention to provide a plastic container which is resistant to breakage, may be stacked in columns on standard size pallets with great stability, may have contents removed from any or all containers of a stack, and may have virtually all liquid contents pumped therefrom while retaining the container in a stacked position.

These and other objects of the present invention including each of the features set forth in the above disclosure will become readily apparent from the following description and the appended drawings.

BEST MODE OF CARRYING OUT INVENTION

Figure 1:
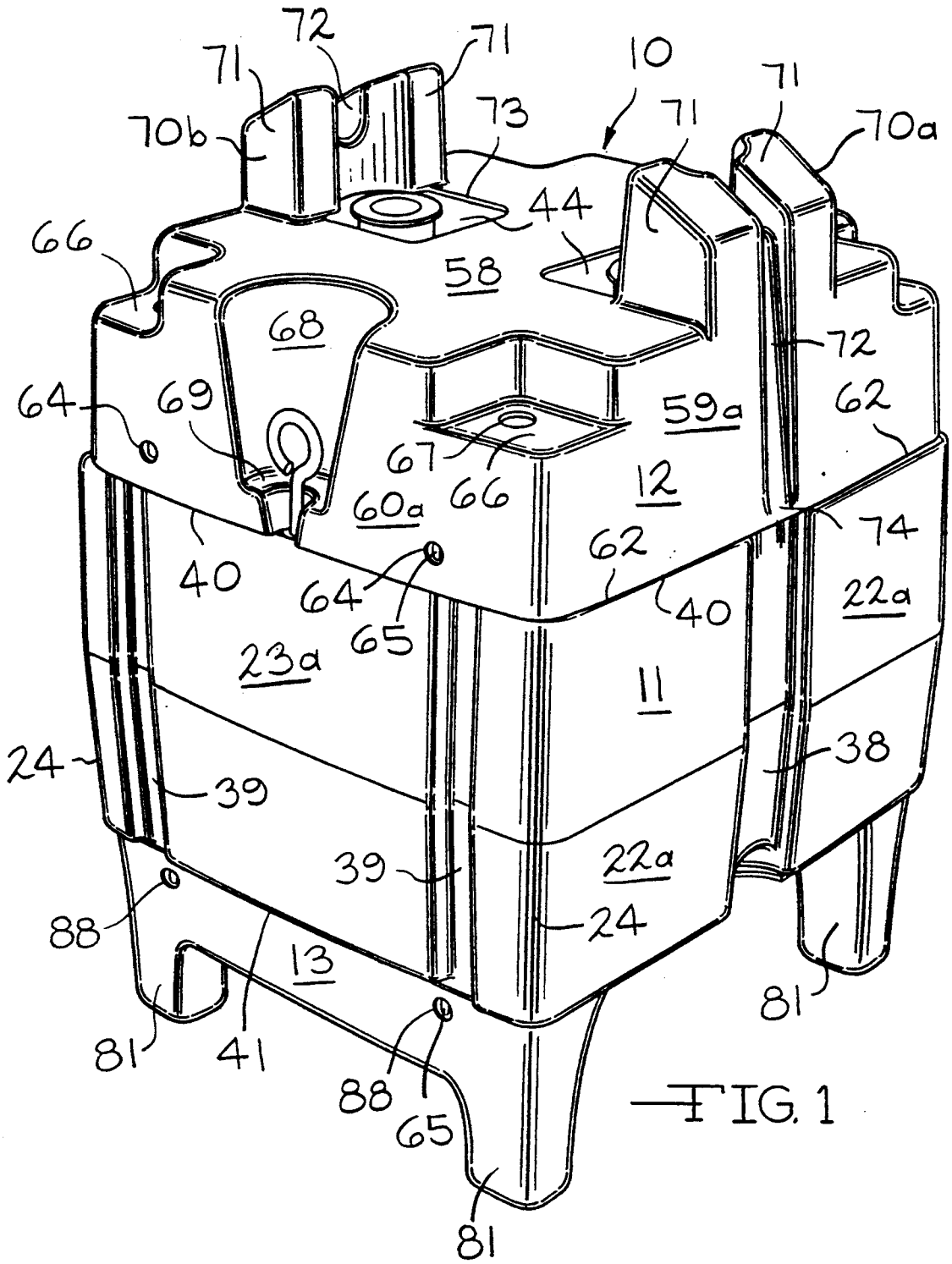
FIG. 1 is a perspective view of the container of the present invention including the tank with the top and bottom members assembled thereto.
Figure 2:
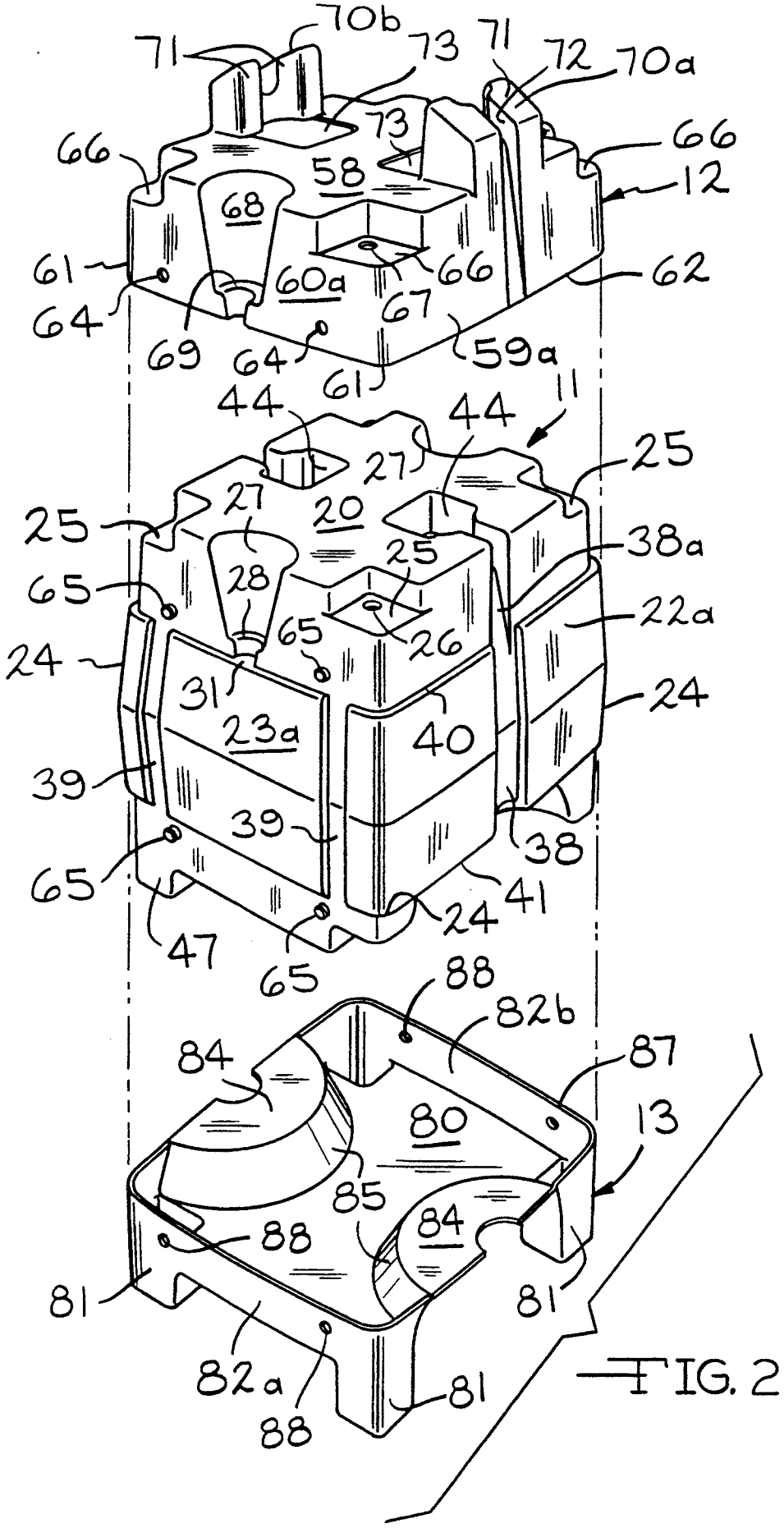
FIG. 2 is an exploded perspective view showing the top and bottom members removed from the tank.
Figure 3:
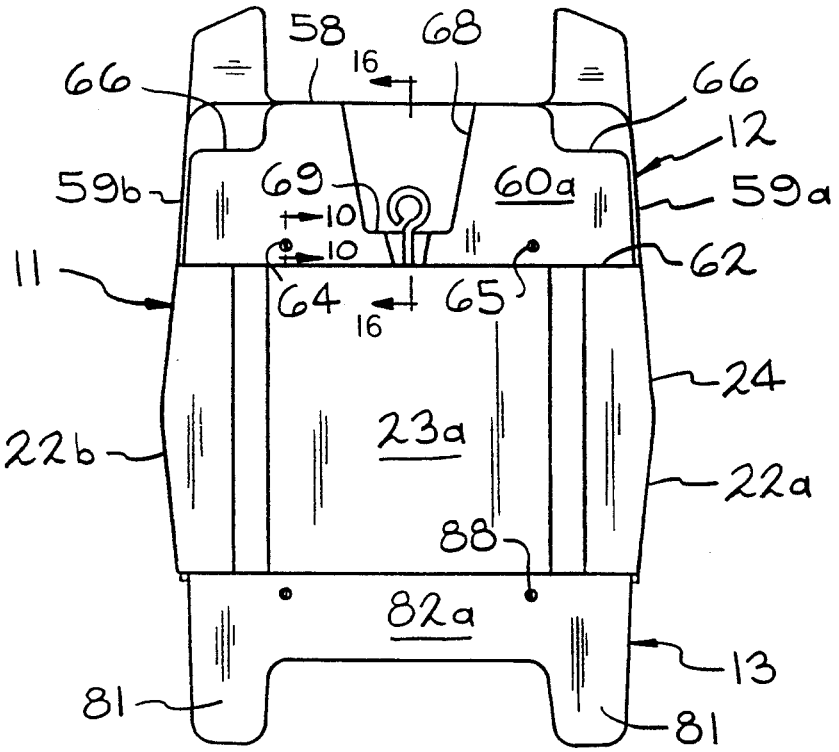
FIG. 3 is an elevational view taken from one side of the container.
Figure 4:
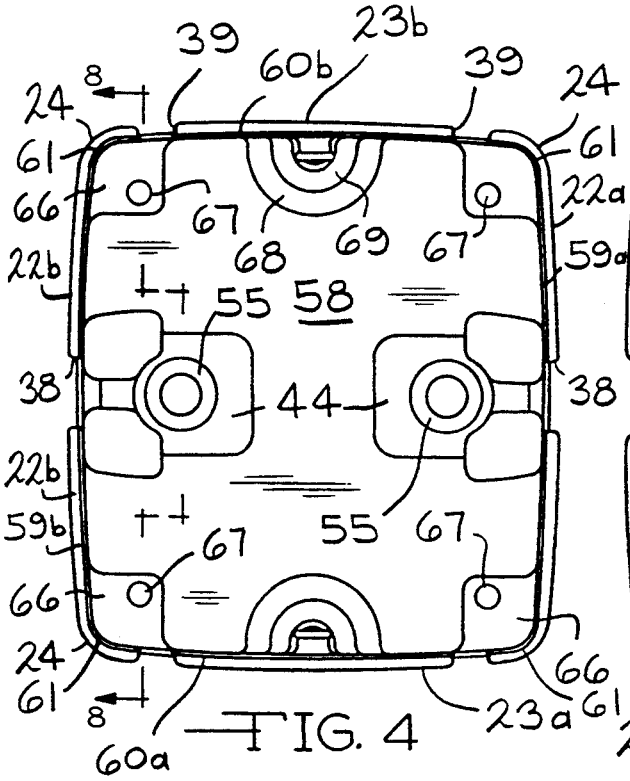
FIG. 4 is a top plan view of the container of the present invention.
Figure 5:
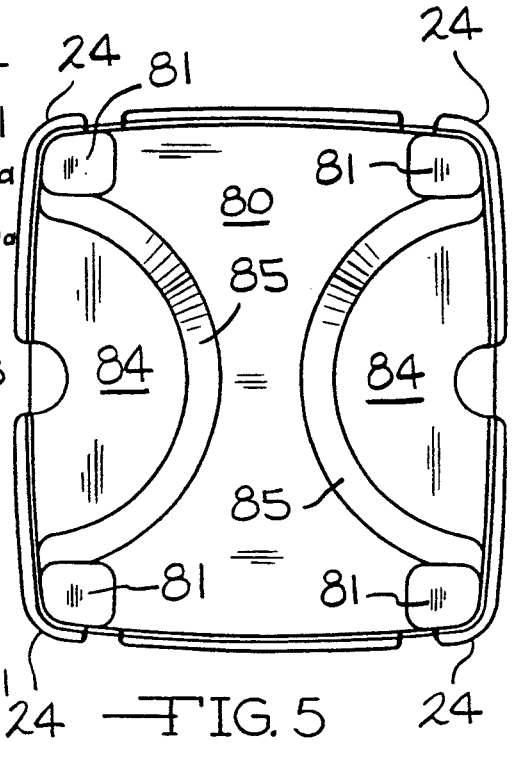
FIG. 5 is a bottom view of such container.
Figure 6:
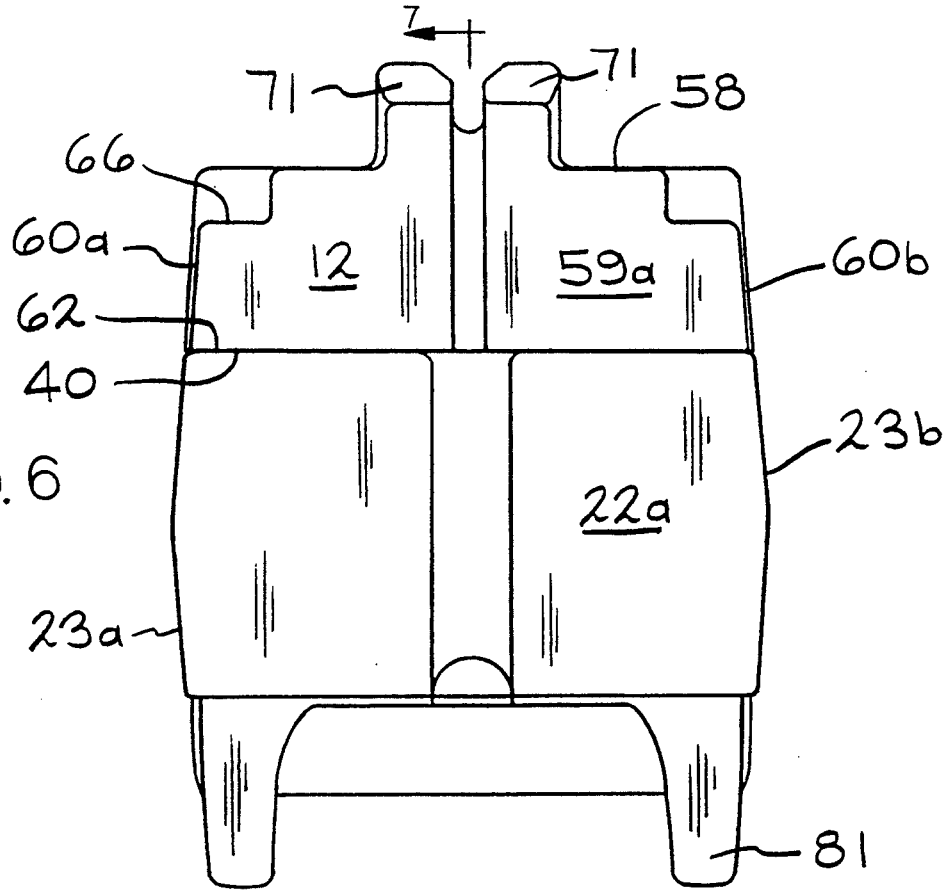
FIG. 6 is an elevational view taken from a side 90° from that of FIG. 3.
Figure 7:
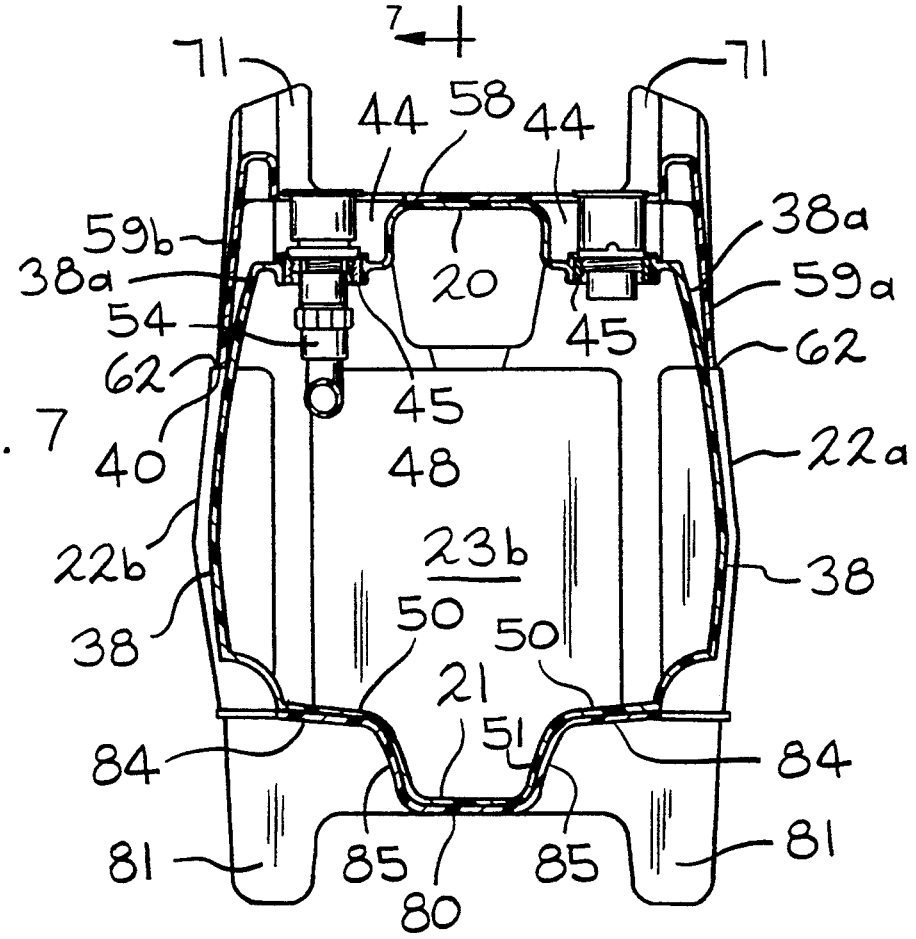
FIG. 7 is a sectional view taken through line 7—7 of FIG. 6.

Referring now to the drawings, there is shown a container generally designated by the numeral 10 comprising a tank 11, a top member 12 and a bottom member 13.

The tank 11 is formed of plastic such as high density polyethylene and preferably is rotationally molded using conventionally known techniques; however, other types of molding methods could be utilized for forming such tank 11 and other types of plastic may be utilized such as high molecular weight polyethylene.

The tank 11, as viewed from the top, has a generally rectangular configuration with rounded corners and slightly bulged side walls. Thus, as may be seen particularly in FIGS. 2, 6–8, 14 and 17, the tank includes a top panel 20, a bottom panel 21, oppositely disposed side panels **22*a* and 22*b* extending between said top panel 20 and said bottom panel 21 and end panels 23*a* and 23*b* adjoining said side panels 22*a* and 22*b* at corners 24 and extending between said top panel 20 and said bottom panel 21**.

At each of the corners 24, the top panel 20 has a recessed area defining a support pad 25. Each of the support pads 25 has a depression 26 formed therein for purposes to be hereinafter described. The support pads 25 and depressions 26 may be most clearly seen in FIGS. 2, 8 and 13.

Figure 16:
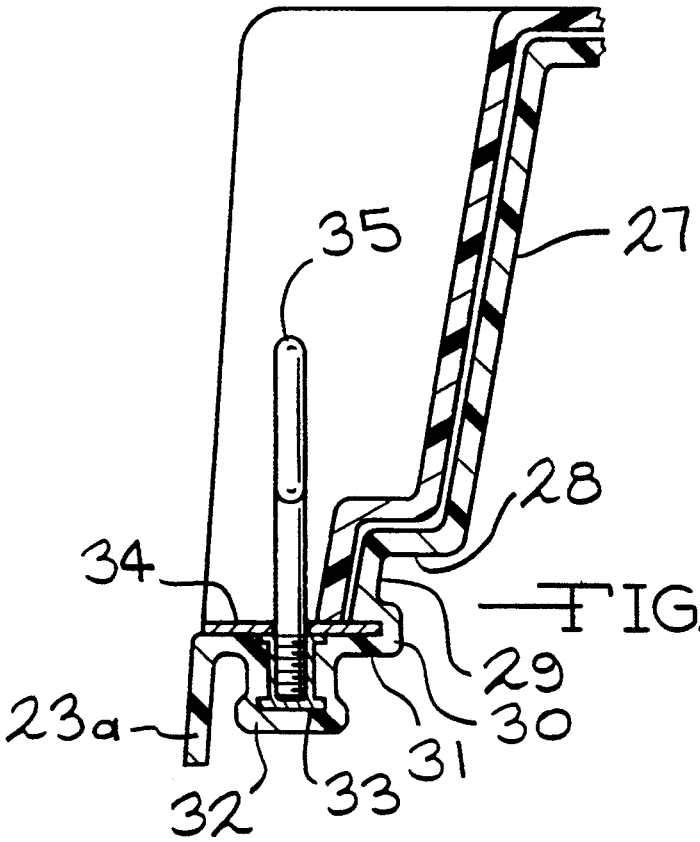
FIG. 16 is a sectional view taken through line 16—16 of FIG. 3.
Figure 17:
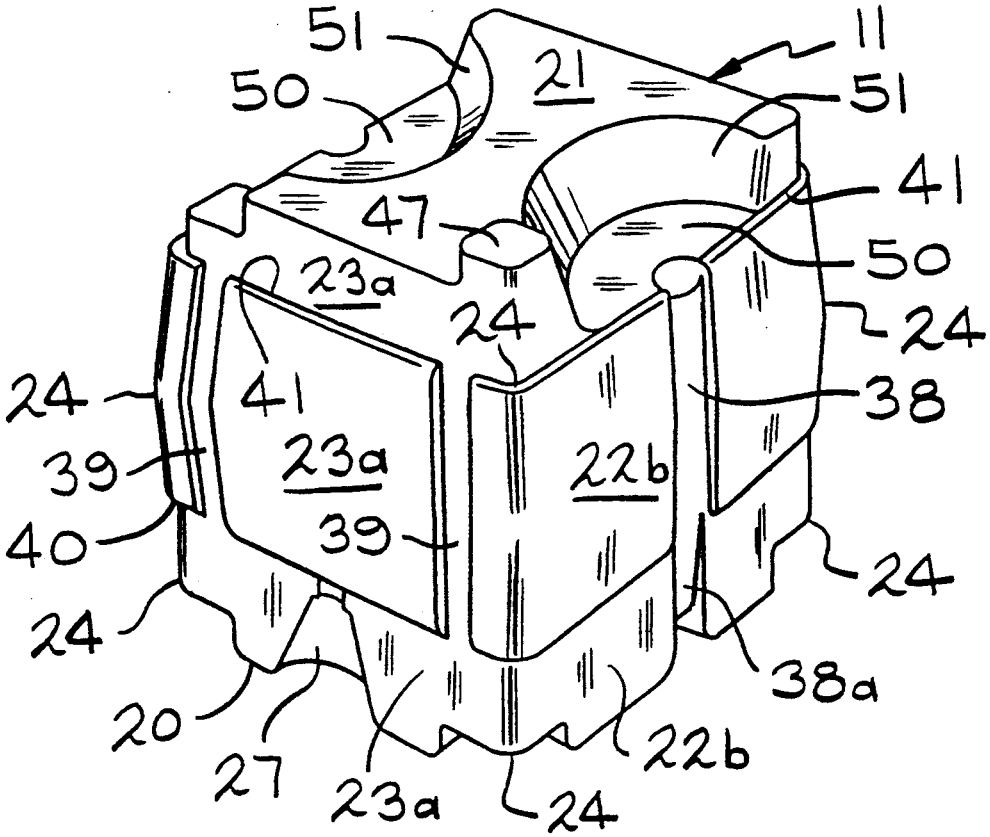
FIG. 17 is a perspective view of the tank with its bottom side up.

The portions of the top panel 20 adjacent each of the end panels **23*a* and 23*b* has formed therein a conical shaped depression 27, each of which extends into its respective end panel 23*a* or 23*b* and downwardly from the top panel 20 to an inwardly directed step 28 from which extends a wall 29 having a groove 30 and washer support pad 31 adjoining the end panel 23*a* or 23*b* adjacent thereto. (See FIG. 16) The washer support pad 31 has a pocket 32 in which is molded in place an internally threaded metal insert 33. A metal washer 34 rests upon the metal insert 33 and has its inner peripheral edge received under the tank wall 29 for maximum tensile strength. An eye-bolt 35 is threadedly received in the insert 33 and extends through the washer 34**.

Each of the side panels **22*a* and 22*b* has a centrally positioned, vertically extending groove 38 formed therein. Similarly, each of the end panels 23*a* and 23*b* has a pair of vertically extending grooves 39, one in the vicinity of but spaced from each of the corners 24. Each of the side panels 22*a* and 22*b* and end panels 23*a* and 23*b* is stepped inwardly over a major area adjacent each of the top panel 20 and bottom panel 21 with the juncture of such stepped areas with the central portions of the respective side panels 22*a*, 22*b* and end panels 23*a*, 23*b* forming an upper abutment 40 and a lower abutment 41 extending horizontally around a major portion of the periphery of the tank 11 with gaps in such abutments 40 and 41 at each of the grooves 38 and 39**.

The top panel 20 has two cavities or wells 44 formed therein. At the bottom of each of the wells 44 is an aperture opening to the interior of the tank 11 in which is permanently mounted a threaded fitting 45 (See FIGS. 7–9). Each of the wells 44 is formed such that it extends to one of the side panels **22*a* or 22*b* in the area of the groove 38. As can be seen particularly in FIGS. 2 and 7, extending upwardly from the groove 38 is an inwardly tapering groove extension 38*a* adjoining the lower portion of each of such wells 44 and extending to meet the main portion of the groove 38 in an area slightly below the abutment 40. As will become clear subsequently, such groove extension 38*a* provides an area for drainage of any water or other liquids which could otherwise accumulate in the wells 44 after the top member 12 is assembled to the tank 11**.

Referring now to FIGS. 2, 7, 8, 14 and 17, the bottom panel 21 of the tank 11 has formed therein a sump 47 forming the lowest portion of the tank 11 when the tank is in an upright position. The bottom panel 21 is formed with a pair of elevated platforms, each having a flat top 50. A sloped wall 51 joins the flat top 50 of the elevated platforms with the bottom panel 21. Each of the sloped walls 51 follows a curved path as viewed in plan forming a semicircle extending at opposite ends to each of the side panels **22*a* and 22*b*, respectively, in an area adjacent the lower abutment 41. The sloped wall 51 defines a segment of a cone of approximately 180°. Thus, as will be appreciated, liquid in the tank 11 will flow from the elevated platforms to the bottom panel 21 and, upon tipping, to the sump 47** where it will be retained until pumped therefrom.

Figure 8:
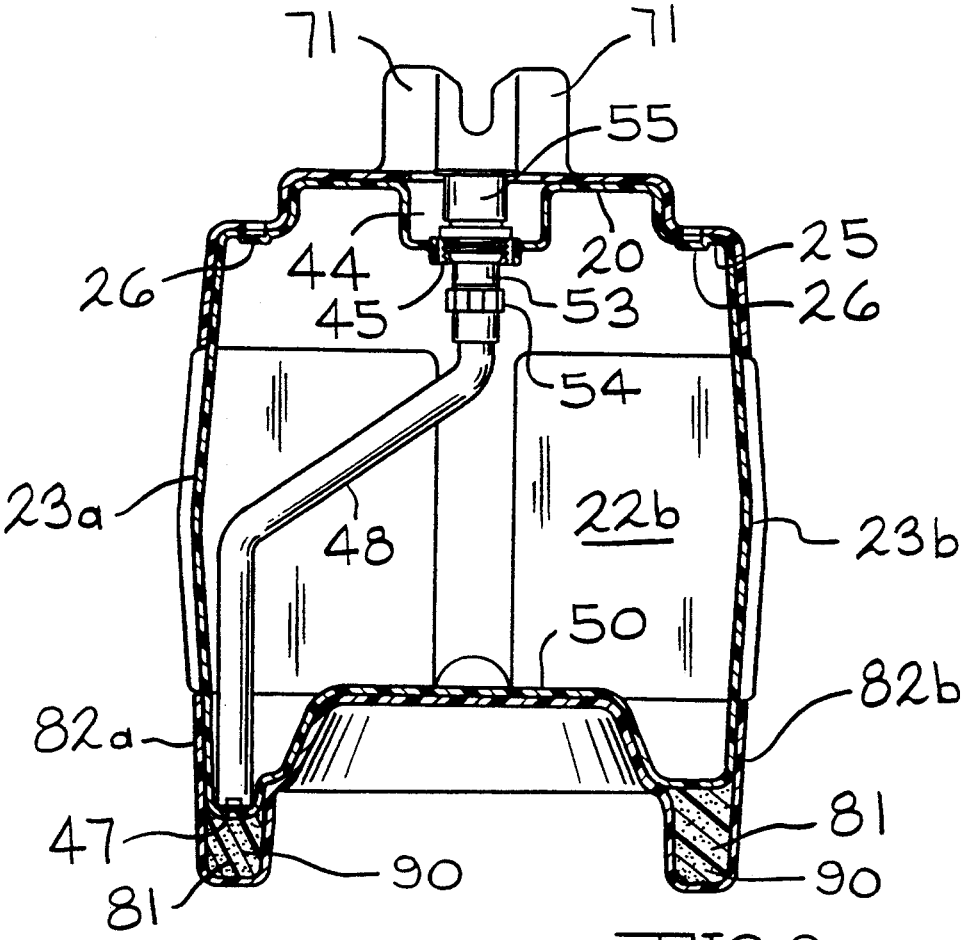
FIG. 8 is a sectional view taken through line 8—8 of FIG. 4.
Figure 9:
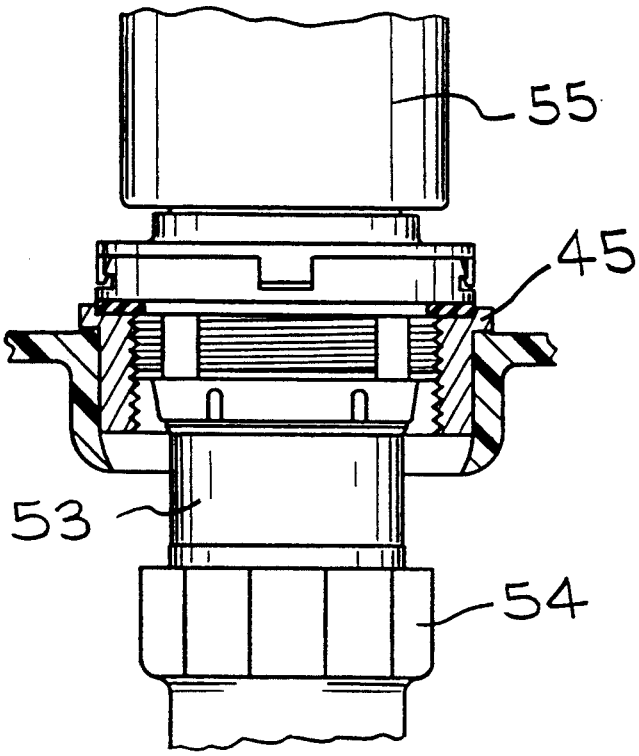
FIG. 9 is a sectional view showing a coupling secured in an opening of the container.

As can be seen particularly in FIGS. 8 and 9, a suction/fill tube 48 may have one end positioned in the sump 47 and the other end connected by means of couplings 53 and 54 to the threaded fitting 45. The sump 47 permits the suction/fill tube to remove virtually all liquid from the tank 11. A one-way valve 55 is mounted above the coupling 53 and may have engaged thereto a pump (not shown) for removing contents from the tank 11. As will be appreciated, any introduction of liquid into the tank or pumping of liquid therefrom will normally be performed following assembly of the top member 12 and bottom member 13 to the tank 11 to form the complete container 10. The one-way valve 55 may be opened to permit the filling of the container 10 only by using a special tool which is normally available only at the chemical supply depot and is not made available to the farmer or other end user. Thus, farmers or other parties using the containers 10 may remove the contents but may not introduce new liquids into the container 10. These types of one-way valves are known in the art and do not of themselves form the present invention.

Referring now to FIGS. 1–4 and 6–8, the top member 12 is also formed preferably of plastic such as high density polyethylene and preferably is vacuum formed over a male mold so that the inner surface will be precisely contoured and dimensioned to mate precisely in critical areas with the tank 11 to which it is mounted. As previously mentioned the tank 11 is preferably rotationally molded with the result that its outer surface will be precisely contoured as it is molded against the inner surface of the rotational mold.

The top member 12 includes a top panel 58, oppositely disposed side panels 59*a* and 59*b* and oppositely disposed end panels 60*a* and 60*b* depending therefrom. The side panels 59*a* and 59*b* and the end panels 60*a* and 60*b* are joined at rounded corners 61. The side panels 59*a*, 59*b*, end panels 60*a*, 60*b* and corners 61 extend downwardly to an abutting edge 62. As may be seen in the figures, the top member 12 is intended to be telescoped over the top of the tank 11 with the abutting edge 62 engaged against the upwardly facing abutment 40 of the tank 11 and the top panel 58 engaged to the top panel 20 of the tank 11. The inner surface of the side panels 59*a* and 59*b*, end panels 60*a* and 60*b* and corners 61 are precisely contoured and sized so that they snugly engage the respective opposing portions of the tank 11. Thus, the inner surface of side panels 59*a* and 59*b* engage, respectively, those outer surfaces of the side panels 22*a* and 22*b* above the upper abutment 40 and the inner surfaces of the end panels 60*a*, 60*b*, respectively, engage the outer surfaces of those portions of the end panels 23*a*, 23*b* above the upper abutment 40.

Figure 10:
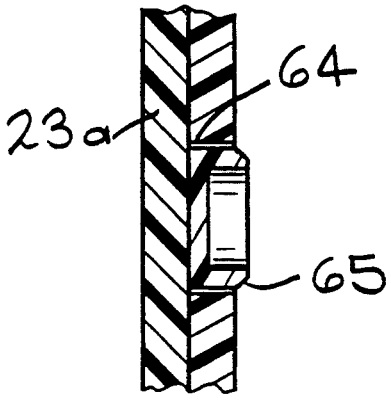
FIG. 10 is a sectional view taken through line 10—10 of FIG. 3.

The end panels 60*a*, 60*b* of the top member 12 each have a pair of apertures 64 formed therein. As may be seen clearly in FIGS. 1, 2 and 10, a button-type fastener 65 is spin welded or otherwise fastened to the portions of the end panels 23*a* of tank 11 which will be aligned with the apertures 64 when the top member 12 is affixed to the tank 11. Thus, when the top member 12 is positioned on the tank 11, the end panels 60*a* and 60*b* will stretch and snap over the fasteners 65 thus providing an interference fit for retaining the top member 12 thereon. As will be appreciated in the event of damage to the top member, it may be stretched or otherwise readily removed from the tank 11, and replaced with a new top member 12 being snapped over the fasteners 65.

The top member 12 is formed with support pads 66 at each corner 61 positioned below the top panel 58 by a distance and of a size such that when the top panel 58 rests upon the top panel 20 of the tank 11, the support pads 66 will rest upon the support pads 25 of the tank 11. As previously mentioned, the abutting edge 62 will abut the abutment 40 of the tank 11. Each of the support pads 66 has an aperture 67 formed therein which is aligned with the depression 26 of each of the support pads 25.

The end panels 60*a*, 60*b* are each formed with a conical-shaped depression 68 extending from the top panel 58 to a stepped portion 69 intended to engage respectively the conical-shaped wall 27 and step 28 of the tank 11.

Extending upwardly from the top panel 58 are a pair of abutments 70*a* and 70*b*. The abutments 70*a*, 70*b* are centrally positioned adjacent the opposing side panels 59*a*, 59*b* and the outer wall of each of such abutments 70*a*, 70*b* lies in the same plane as the outer surface of its respective side panel 59*a*, 59*b*. Each of the abutments 70*a*, 70*b* includes a pair of posts 71 separated by a recessed area forming a groove 72 intended to be aligned with and fit within the groove extension 38*a* of tank 11. The top panel 58 also has a pair of apertures 73 having substantially the same size as and aligned with the upper ends of the cavities 44 permitting access to the one-way valve 55 and couplings 53 and 54 leading to the interior of the tank 11.

The abutments 70*a*, 70*b* combine with the assembled pump height to protect any coupling which may be engaged to the threaded fittings 45. Thus, in the event the container 10 is dropped such that any portion of the top member 12 is impacted, the abutments 70*a*, 70*b* combine with the attached pump and will serve to absorb the impact and protect the coupling or valve from being damaged or the engagement with the threaded fitting being knocked loose causing leakage. The configuration of the abutments 70*a*, 70*b* with the posts 71 separated by the grooves 72 gives sufficient strength to provide good protection resulting from dropping or impacting of the container 10. The groove 72 also serves to support the suction hose in a way to minimize side load on the coupling if the pump is utilized from ground level instead of from the container top 58.

As will be appreciated, when the containers 10 are used outdoors, they will be exposed to the elements including rain. However, rain will not accumulate in the cavities 44 but rather will be permitted to drain through the groove extensions 38*a* which are spaced from the inner surface of the top member 12. Thus, as may seen in FIGS. 1,2 and 7, the groove 72 separating the posts 71 fades out at the lower portion adjacent the abutting edge 62 in the area designated by the numeral 74 thus providing a clear path for drainage of water or other liquid from the cavities 44.

Figure 15:
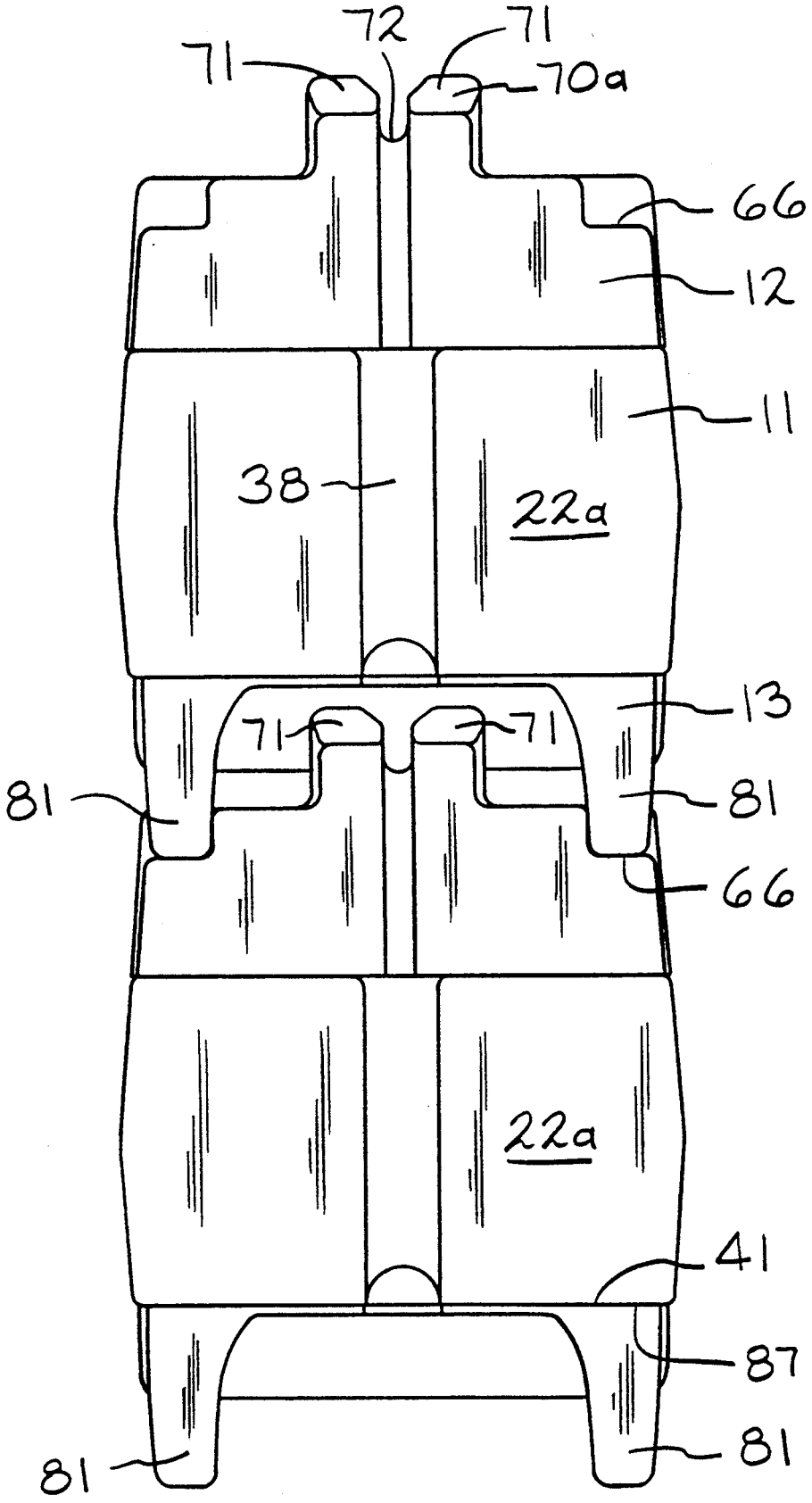
FIG. 15 is a view showing two containers stacked one upon the other viewed in a direction 90° from the direction of the containers shown in FIG. 11.

The skid or bottom member 13 is also vacuum formed over a male mold and includes a bottom panel 80 with four downwardly extending legs 81, one at each corner, and upwardly extending ends 82*a* and 82*b*. A pair of elevated platforms each having a flat top 84 extend upwardly above the bottom panel 80 and are joined thereto by arcuate sloping walls 85. The elevated platforms have a size and configuration causing the flat tops 84 and arcuate sloping walls 85 to engage snugly with the respectively aligned flat top 50 and sloped walls 51 forming the elevated platforms of the tank 11 when the bottom member 13 is assembled thereto. (see FIG. 7). As may be seen particularly in FIG. 15, the design is such as to provide spaces within which the upwardly extending abutments 70*a* and 70*b* with their posts 71 may be received when a second container is positioned thereon with its legs 81 resting upon the support pads 66 of the lower container. As will be appreciated from view FIG. 15 along with FIG. 11, the space between stacked containers will also permit entry of the tines of a forklift and access to the one-way valve 55 of the lower container as well as the upper container.

The upper portion of the legs 81 and of the ends 82*a* and 82*b* terminate in the same plane as that defined by the flat top 84 of the elevated platform and define an abutting edge 87 which will engage the lower abutment 41 of the tank 11 when the bottom member 13 is affixed thereto.

Each of the end panels 82*a* and 82*b* has a pair of apertures 88 formed therein for engagement by the fasteners 65 affixed to the portion of the respective end panels 23*a* and 23*b* below the lower abutment 41.

The unique design of the container 10 of the present invention, with the skid or bottom member 13 thus engaged to the tank 11 provides, in addition to the strength, impact resistance and stackability advantages heretofore mentioned, several other advantages. Thus, in the event of leakage of liquid from the tank 11 in an area covered by the bottom member 13, the liquid will not flow directly to the ground or warehouse floor but rather will flow into the bottom member 13 then to the apertures 88 and ooze therefrom providing a leak detection feature.

Preferably, each of the legs 81 has foamed plastic 90 or other structural supporting material therein to provide for impact and compression resistance thereto. (See FIG. 8)

Referring to FIGS. 11–13 and 15, when it is desired to stack the containers 10 in a column, a container 10 may be lifted by any desired power mechanism such as one engaging the eye-bolts 35 or by the tines of a fork-lift positioned between the legs 81. Such lifted container 10 is then positioned on a lower container with each of the legs 81 of such lifted container resting upon the support pads 66 of the top member 12 of the lower container 10. Since the support pads 66 are positioned below the top panel 58, the legs 81 of an upper container resting thereon will be essentially in an anti-skid relationship with the lower container. Load from the upper container to the lower container will be transmitted through the top member 12 of such lower container 1 0, through the side panels 59*a* and 59*b*, end panels 60*a* and 60*b* and corners 61 to the abutting face 62 engaging the upper abutment 40 of such lower container. Such load is transmitted to the side panels 22*a* and 22*b*, end panels 23*a* and 23*b* and corners 24 of the lower container to the lower abutment 41 and, thence, to the end panels 82*a* and 82*b* and legs 81 of the bottom member 13 with the foam plastic 90 in such legs providing additional reinforcement.

Figure 11:
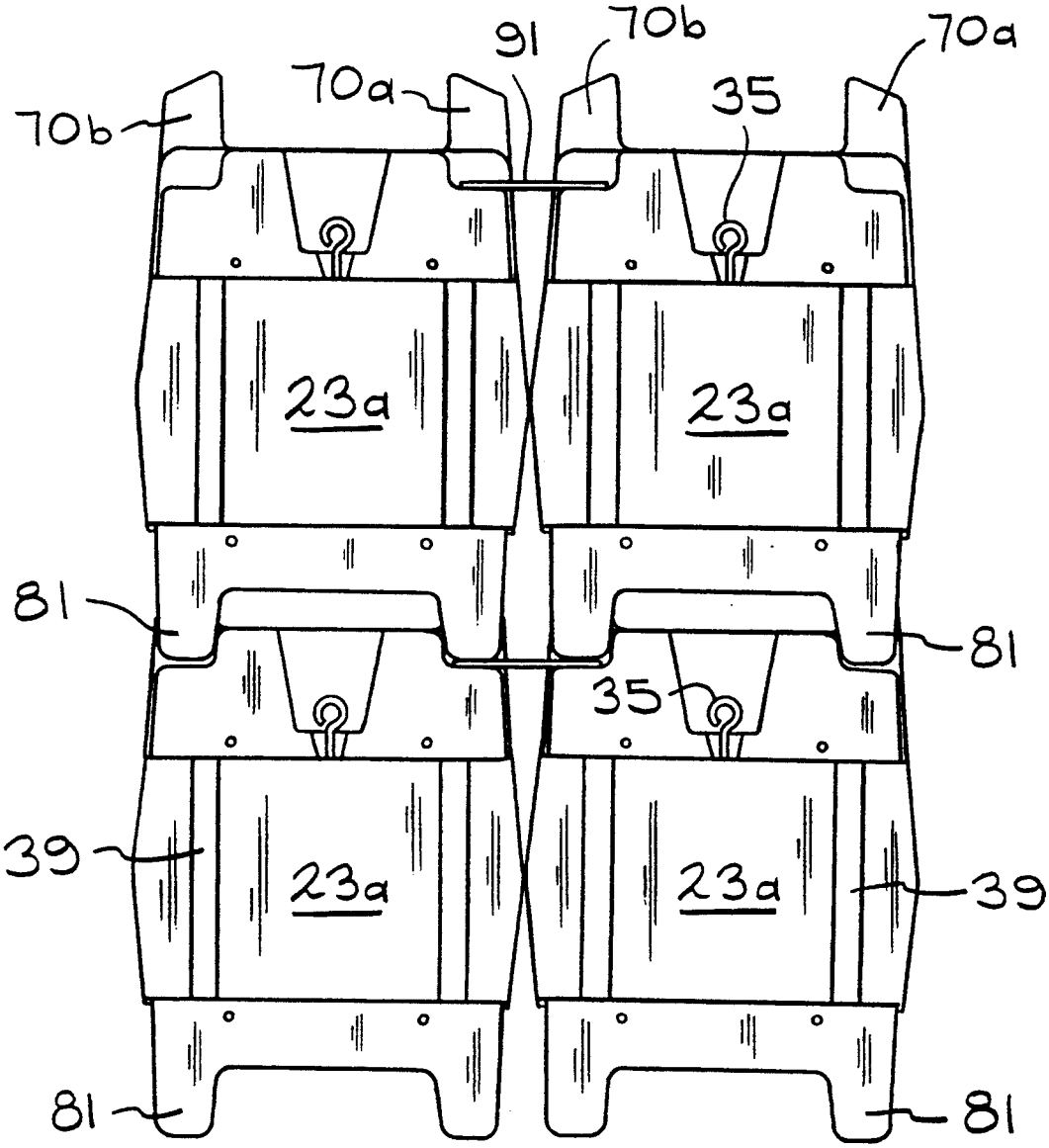
FIG. 11 is an elevational view showing containers stacked in two columns and interlocked together.
Figure 12:
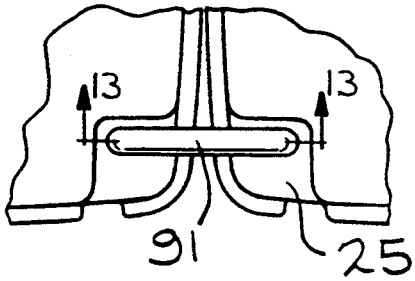
FIG. 12 is an enlarged fragmentary view of two adjacent containers showing the interlocking means.
Figure 13:
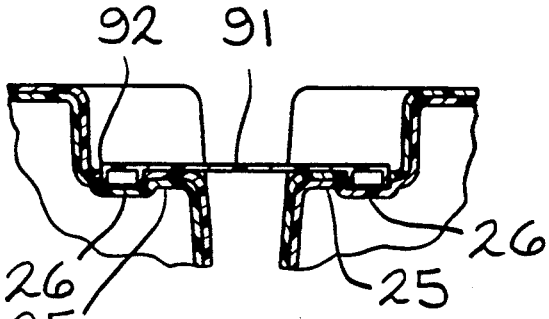
FIG. 13 is a sectional view taken through line 13—13 of FIG. 12.
Figure 14:
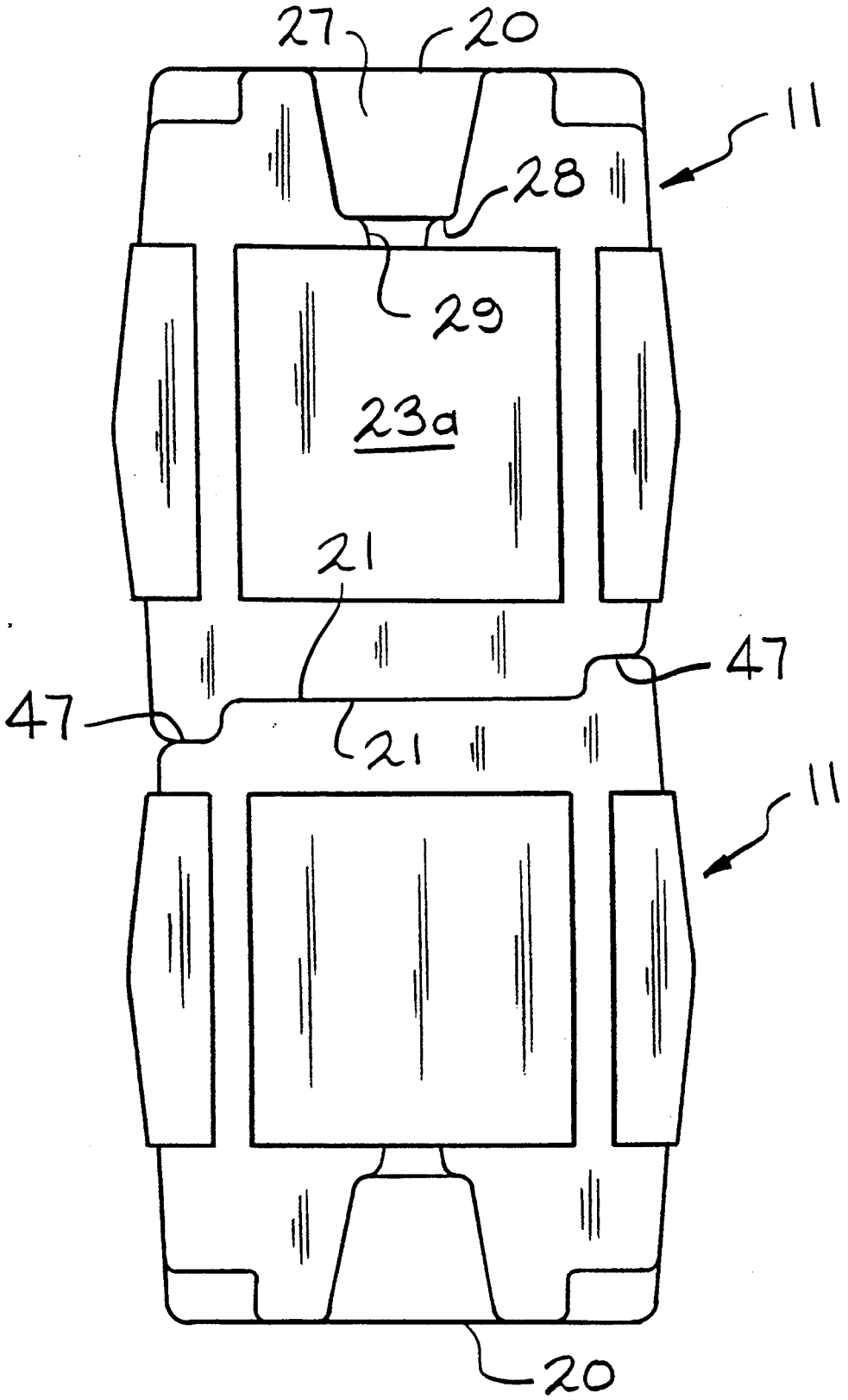
FIG. 14 is a view showing two tanks without top and bottom members assembled thereto and stacked one upon the other with the bottom tank upside down and the top tank in an upright position.

Depending upon the height of the stack, it is desirable to stabilize it. As can be seen in FIGS. 11–13, this may be accomplished by providing a strap 91 having a circular projection 92 on each end sized and positioned to be received by non-friction fit within the depression 26 of adjacent containers 10. As will be appreciated, the projections 92 will extend through the apertures 67 of the respective top members 12 in order to reach and become non-frictionally engaged with the depressions 26 of the tank 11 portions of adjacent containers 10. This arrangement allows for stacking stability and automatic ejection of the straps 91 during removal of the top container when using a lift truck.

As will be appreciated and as can be seen from the drawings, the construction of the container 10 of the present invention is such that sufficient space is permitted between a lower container and ones stacked thereon to reach coupling or other dispensing means positioned thereon. The construction ensures that virtually all of the chemical contained therein will be removed as a result of the sump, provides a construction resistance to breakage, permits drainage of water, permits stacking and access to all containers of a stack for dispensing. Additionally, the grooved construction of the side walls, in addition to providing a configuration for supporting loads, also provides an anti-bulge feature. The column interlock through use of the straps provides stability to a load.

Many modifications will be apparent to those skilled in the art. Accordingly, the scope of the present invention should be limited only by the scope of the appended claims.

I claim:

1. In combination, a first tank and a second tank stacked thereon, said first and second tanks having similar configurations and being capable of containing liquid, each said tank comprising a bottom, first, second, third and fourth side walls extending upwardly from said bottom, said side walls defining a generally rectangular cross-sectional configuration and a top joined to said side walls, said first and second side walls adjoining to form a first corner, said second and third side walls adjoining to form a second corner, said third and fourth side walls adjoining to form a third corner, said fourth and first side walls adjoining to form a fourth corner, a sump at said first corner extending downwardly from said bottom, said bottom contoured to direct the flow of liquid to said sump, an internal raised area at said second corner positioned above said bottom by a distance at least equal to the distance said pump extends below said bottom, said raised area forming an external ledge when said tank is inverted said first and second tanks being positioned in bottom-to-bottom relationship such that the bottom of said first tank is engaged by the bottom of said second tank with the sump of said second tank engaging said external ledge of said first tank.

2. In combination, a first tank and a second tank stacked thereon, said first and second tanks having similar configurations and being capable of containing liquid, each said tank comprising a bottom, first, second, third and fourth side walls extending upwardly from said bottom, said side walls defining a generally rectangular cross-sectional configuration and a top joined to said side walls, said first and second side walls adjoining to form a first corner, said second and third side walls adjoining to form a second corner, said third and fourth side walls adjoining to form a third corner, said fourth and first side walls adjoining to form a fourth corner, a sump area at said first corner defining a sump extending downwardly from said bottom, an internally raised area at one of said second, third or fourth corners positioned above said bottom by a distance at least equal to the distance said sump extends below said bottom, said internally raised area defining an external depression and forming an external ledge when said tank is inverted said first and second tanks being positioned with said first tank inverted and said second tank upright such that said tanks are in bottom-to-bottom relationship and said sump area of said first tank mates with said external depression of said second tank and said sump area of said second tank mates with said external ledge of said first tank.

3. In combination, a first tank and a second tank stacked thereon, said first and second tanks having similar configurations and being capable of containing liquid, each said tank comprising a bottom, first, second, third and fourth side walls extending upwardly from said bottom, said side walls defining a generally rectangular cross-sectional configuration and a top joined to said side walls, said first and second side walls adjoining to form a first corner, said second and third side walls adjoining to form a second corner, said third and fourth side walls adjoining to form a third corner, said fourth and first side walls adjoining to form a fourth corner, a sump area at said first corner defining a sump extending downwardly from said bottom, an internally raised area at said second corner positioned above said bottom by a distance substantially equal to the distance said sump extends below said bottom, said internally raised area defining an external ledge when said tank is inverted said first and second tanks being positioned with said first tank inverted and said second tank upright such that said tanks are in bottom-to-bottom relationship and said sump area of said first tank mates with said external depression of said second tank and said sump area of said second tank mates with said external ledge of said first tank.

* * * * *